US006092690A

United States Patent [19]

Bitowft et al.

[11] Patent Number: 6,092,690

[45] **Date of Patent: *Jul. 25, 2000**

[54] WET-WIPE CONTAINER HAVING A HINGED COVER

[75] Inventors: Bruce Kevin Bitowft, Glashutten; Martin Werner Frank, Frankfurt, both of Germany

[73] Assignee: The Procter & Gamble Company, Cincinnati, Ohio

[ * ] Notice: This patent issued on a continued prosecution application filed under 37 CFR 1.53(d), and is subject to the twenty year patent term provisions of 35 U.S.C. 154(a)(2).

[21] Appl. No.: 08/737,051

[22] PCT Filed: May 3, 1995

[86] PCT No.: PCT/US95/04959

§ 371 Date: Nov. 4, 1996

§ 102(e) Date: Nov. 4, 1996

[87] PCT Pub. No.: WO95/30593

PCT Pub. Date: Nov. 16, 1995

[30] Foreign Application Priority Data

May 4, 1994 [EP] European Pat. Off. ..... 94107012

[51] Int. Cl.[7] ..... B65D 43/16; B65D 43/24

[52] U.S. Cl. ..... 220/831; 206/494; 220/254; 220/259; 222/556

[58] Field of Search ..... 206/494; 220/254, 220/335, 259; 222/556

[56] References Cited

U.S. PATENT DOCUMENTS

| | | | |
|---|---|---|---|
| 3,272,379 | 9/1966 | Driza et al. | 220/31 |
| 3,982,659 | 9/1976 | Ross | 221/63 |
| 3,986,479 | 10/1976 | Bonk | 118/506 |
| 4,101,026 | 7/1978 | Bonk | 206/205 |
| 4,343,397 | 8/1982 | Nozawa et al. | 220/335 |
| 4,441,637 | 4/1984 | Libit | 222/556 |
| 4,535,912 | 8/1985 | Bonk | 221/46 |
| 4,759,478 | 7/1988 | Richardson et al. | 222/556 |
| 5,040,680 | 8/1991 | Wilson et al. | 206/459 |
| 5,156,291 | 10/1992 | Mielke | 220/254 |
| 5,337,911 | 8/1994 | Holub | 220/254 |
| 5,368,188 | 11/1994 | Twardowski | 221/50 |
| 5,402,904 | 4/1995 | Close | 220/254 |
| 5,542,585 | 8/1996 | Peters et al. | 222/556 |
| 5,579,961 | 12/1996 | Zimmerman | 222/556 |

FOREIGN PATENT DOCUMENTS

| | | | |
|---|---|---|---|
| 1306254 | 9/1962 | France . | |
| 9111415 | 3/1993 | Germany | A45C 13/06 |

*Primary Examiner*—Stephen P. Garbe
*Attorney, Agent, or Firm*—Roddy M. Bullock; Larry L. Huston; E. Kelly Linman

[57] ABSTRACT

The invention relates to a container for containing a stack of moist wipes, the container comprising a container body and a lid covering the container body, the lid comprising a dispensing aperture and a hinging cover connected to the lid and overlying the dispensing aperture, wherein the hinging cover is pivotable around a hinging axis.

9 Claims, 4 Drawing Sheets

WET-WIPE CONTAINER HAVING A HINGED COVER

BACKGROUND OF THE INVENTION

Such a container is known from GB-A-1 476 303. In this patent application a container is described which consists of an upper part and a lower part, which parts can be separated for introducing a fresh stack of wet wipes into the container. The upper part comprises a slit-like dispensing aperture which is covered by a hinging lid.

The known container has as a disadvantage that the lid upon opening protrudes beyond the perimeter of the container. Hence the container needs to be placed on a support on which sufficient clearance is provided to open the lid.

Containers in which the hinging of the lid is limited to a predetermined maximum by means of abutting of the lid against a stopping surface, are known in art. These containers often have the disadvantage that upon accidentally exerting an excess force on the cover, the container can topple over, or the cover can break off the container.

It is an object of the present invention to provide a container for wet wipes which can easily be opened while using one hand.

It is a further object of the invention to provide a container for wet wipes which upon opening takes up relatively little space.

It is again a further object of the invention to provide a container for wet wipes which does not easily topple over once the cover is opened, and in which the cover does not break off upon exertion of a relatively large force on the cover.

It is another object of the invention to provide a container for wet wipes that remains in an opened position by itself.

SUMMARY OF THE INVENTION

The container in accordance with the invention is characterised in that the container further comprises retention means for keeping the cover in a first opened position in which the cover is pivoted around the hinging axis by less than 180°, preferably less than 135°, upon exertion of a predetermined force on the cover, the cover being further hingeable around the hinging axis from its first open position to a second open position by exertion of a second predetermined force on the lid.

Once the cover is opened, it is locked in position by the retention means such that it does not fall or bounce back to its closed position and it does not hinge further towards a position in which the cover is parallel to the lid of the container and substantially protrudes beyond the perimeter of the container. Upon exertion of an excessive force on the cover, the cover is released from the retention means and hinges further around the hinging axis.

The possibility of further opening of the lid beyond the position that is determined by the retention means helps to prevent the container from toppling over in the event an excessive force is accidentally exerted on the cover. Accidental breaking of the cover from the lid is also prevented.

In an embodiment of the container according to the invention, the retention means comprises a first protrusion provided on the cover, the first protrusion being located near the hinging axis, and a second protrusion provided on the lid, the first protrusion upon opening of the cover being rotatingly engageable with the second protrusion to prevent further opening of the cover.

Upon opening of the cover, the protrusions engage and form a stop to further movement of the cover around the hinging axis. Preferably a further protrusion is provided which forms a resistance against closing of the cover, once it has been opened.

The protrusions may each comprise a sliding surface which terminates in an edge. In this case the edge of the protrusion on the cover slides upon opening over the sliding surface of the protrusions on the lid. The cover is placed in its opened position by sliding the edge of the protrusion on the cover across the sliding surface of the first protrusion on the lid, past the sharp of the first protrusion. The cover can be moved beyond its first open position by sliding the edge of the protrusion on the cover across the sliding surface of the second protrusion on the lid that forms a stop against further opening, past the edge of the second protrusion.

Alternatively, the protrusions on the lid comprise a single member having a recession, the protrusion on the hinging cover may be slightly rounded to engage with the member on the lid upon rotation of the cover.

BRIEF DESCRIPTION OF THE DRAWINGS

The invention will be explained in detail with reference to the accompanying drawings. In the drawings.

DETAILED DESCRIPTION OF THE INVENTION

Figure 1:
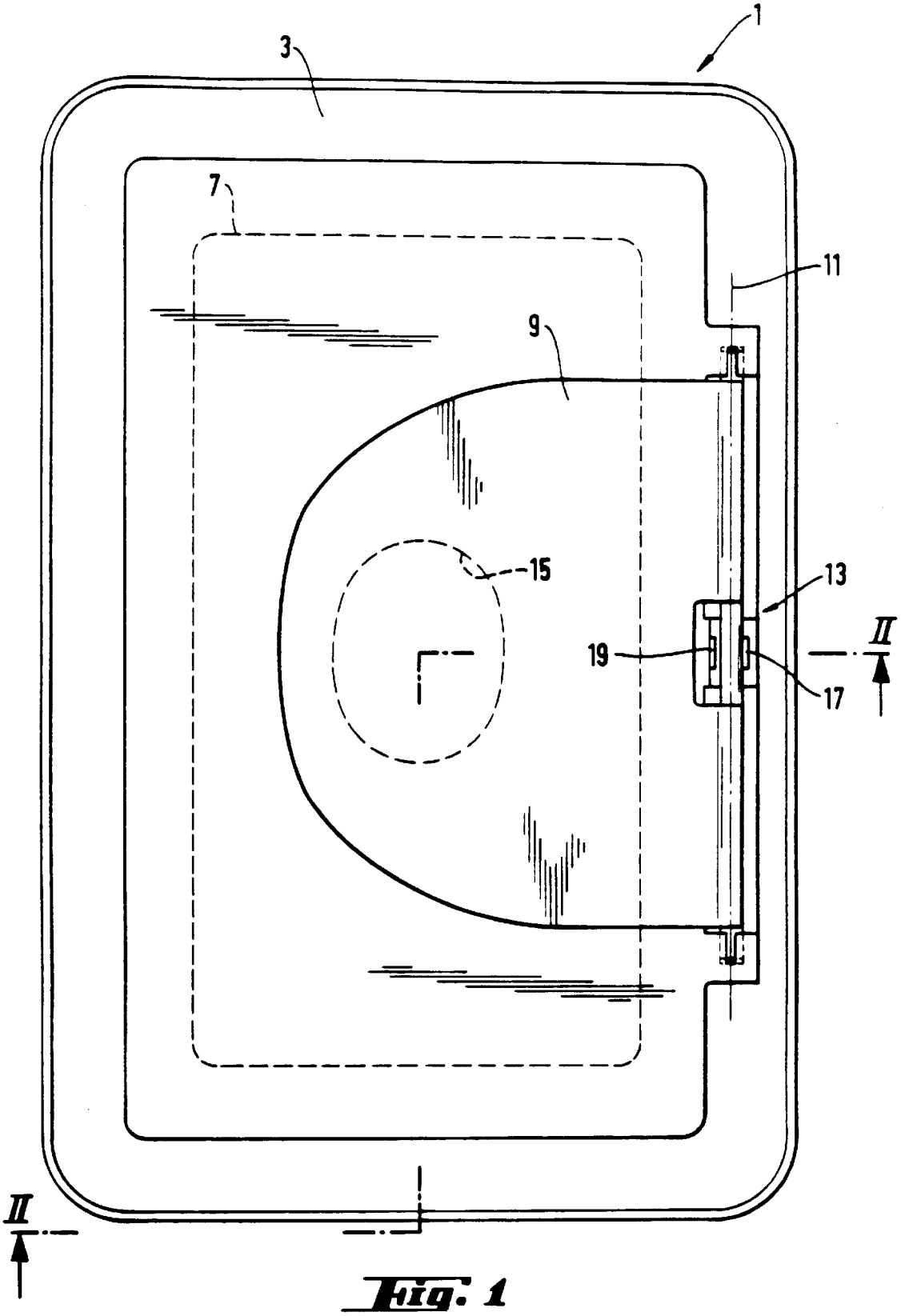
FIG. 1 shows a top view of the container according to the invention.
Figure 2:
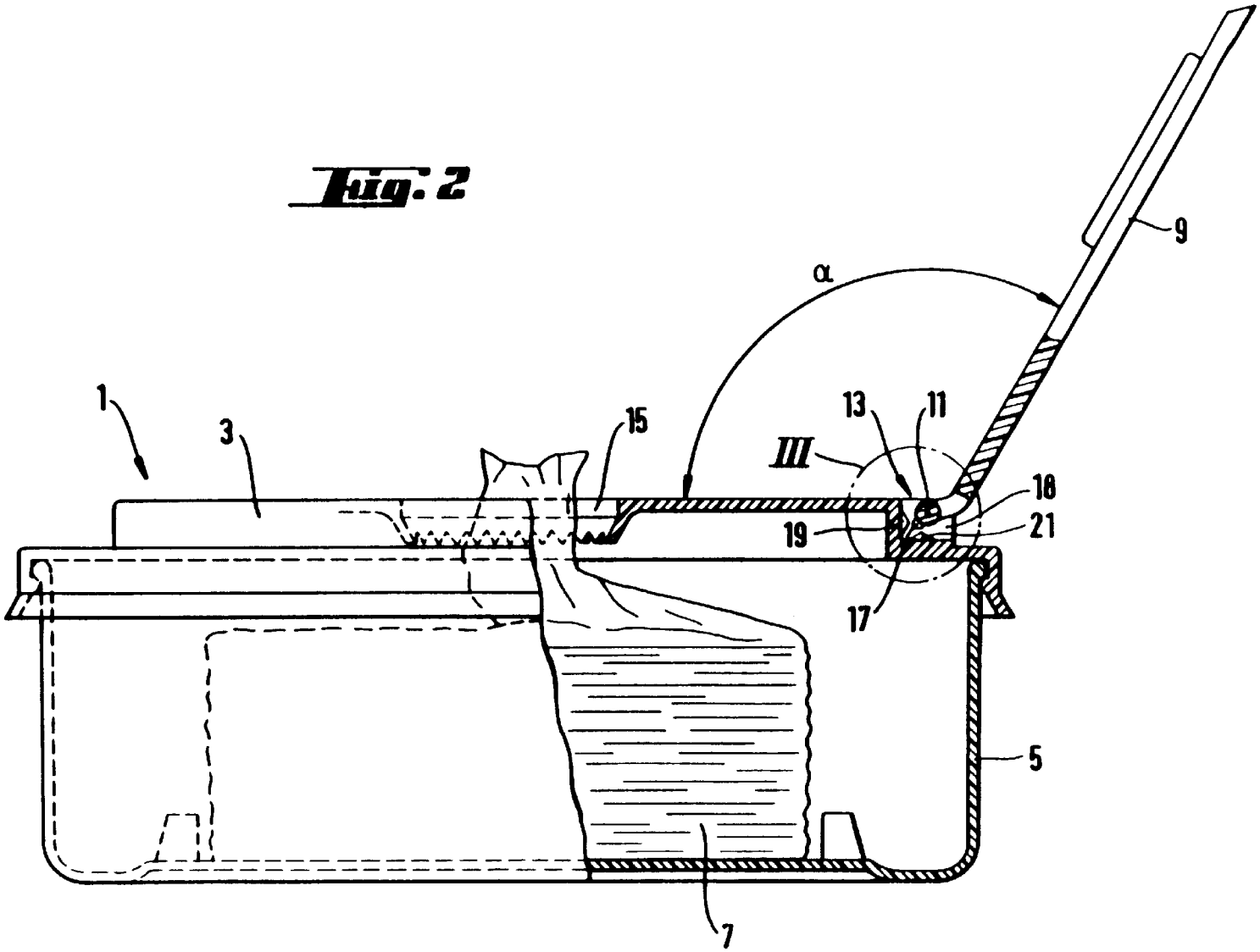
FIG. 2 shows a side view of a container according to the invention.

FIGS. 1 and 2 show a container 1 comprising a lid 3 and a container body 5. The lid 3 can be removed from the container body to insert a stack of moist wipes 7 into the container. The lid 3 is for instance connected to the container body by means of a hinge or can be clamped onto the container body 5. The lid 3 covers the container body 5 in a liquid tight manner, such that drying out of the contents of the container is prevented.

A cover 9 is hingingly connected to the lid 3 and can hinge around a hinging axis 11. As can be seen in FIG. 1, the lid 3 comprises a dispensing aperture 15 through which the wipes can be removed from the container 1. The dispensing aperture 15 is sealingly covered by the cover 9.

Figure 3:
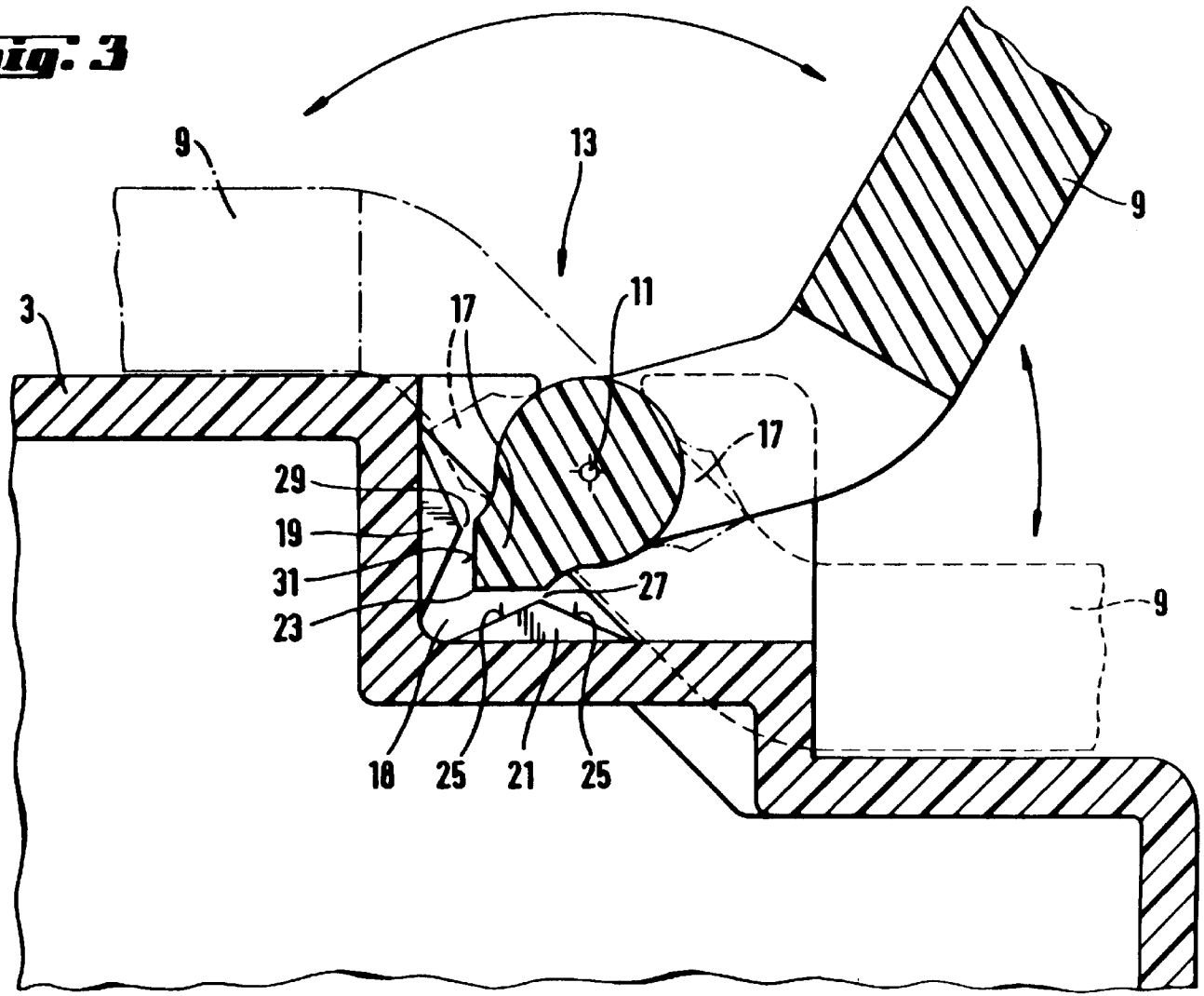
FIG. 3 shows an enlarged side view of the retention means of the container of FIGS. 1 and 2, and FIGS. 4, 5 and 6 show enlarged side views of alternative embodiments of the retention means.

As can be seen from FIG. 3, the retention means 13 comprise a protrusion 17 on the cover 9 and two protrusions 19 and 21 on the lid 3. The protrusion 17 on the cover 9 comprises a relatively sharp edge 23 that upon opening of the cover 9 from its closed position, slides across surface 25 of the protrusion 21. When the edge 23 slides past the sharp edge 27 of the protrusion 21, the cover 9 is in its first open position. The protrusion 17 on the cover 9 is caught in a recess 18 between the protrusions 19 and 21 on the lid 3 and is maintained in its opened position, the cover 9 being prevented from further opening by the protrusion 19. In its opened position, the cover 9 is hinged around the hinging axis 11 by an angle alpha which can vary between 75° and 135°.

Upon exertion of a larger force on the cover 9, the sharp edge 29 engages the surface 31 of the protrusion 17. When the edge 23 of the protrusion 17 slides past the edge 29 of the protrusion 19, the cover is completely flipped back and is put in its second open position. The cover 9 can be closed from its first open position or can be moved beyond its first open position by exertion of a force of about 1 to 50 N on the cover 9. By allowing the cover 9 to completely flip open, toppling of the container 1 can be prevented when too large a force is accidentally exerted on the cover 9. Furthermore, it is prevented that the cover 9 breaks away from the lid 3 when forced backwards.

Figure 4:
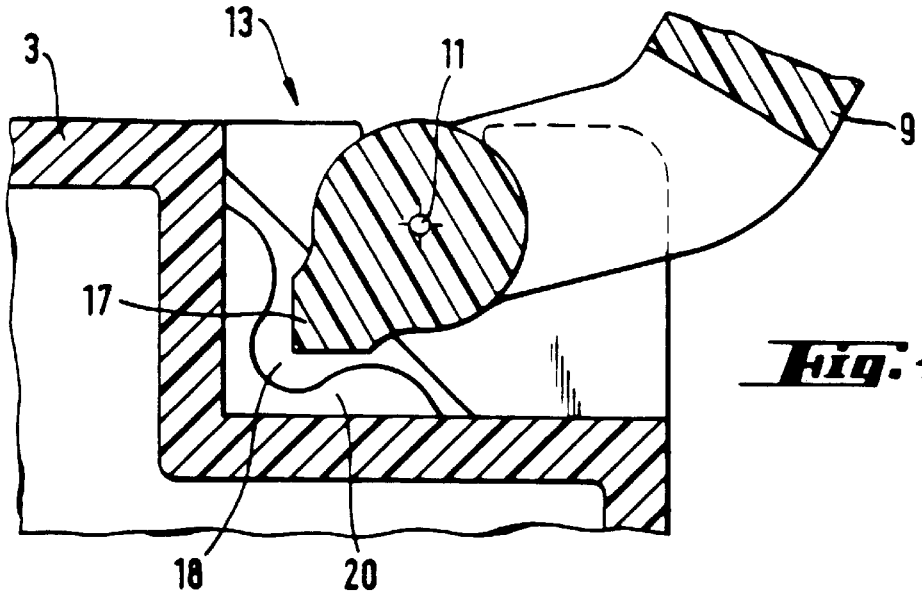

FIG. 4 shows an embodiment wherein the retention means comprises a single piece of material 20 on the cover 3 wich single piece of material comprises a recession 18 and which engages with the protrusion 17 on the cover 9.

Figure 5:
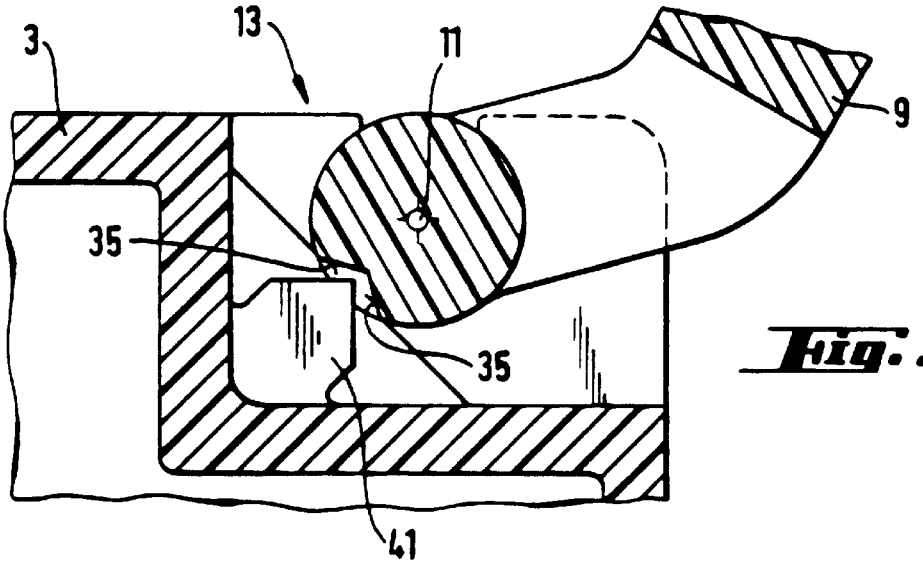

FIG. 5 shows an embodiment in which the cover 9 is provided with a stopping surface 35, which upon opening of the cover engages the protrusion 41. The orientation of the stopping surface 35 determines the extent by which the cover 9 can be opened. It has been found that for easy, one-handed access to the wipes in the container, the lid 9 should be opened at an angle alpha between 75° and 135° with respect to the lid 3.

Figure 6:
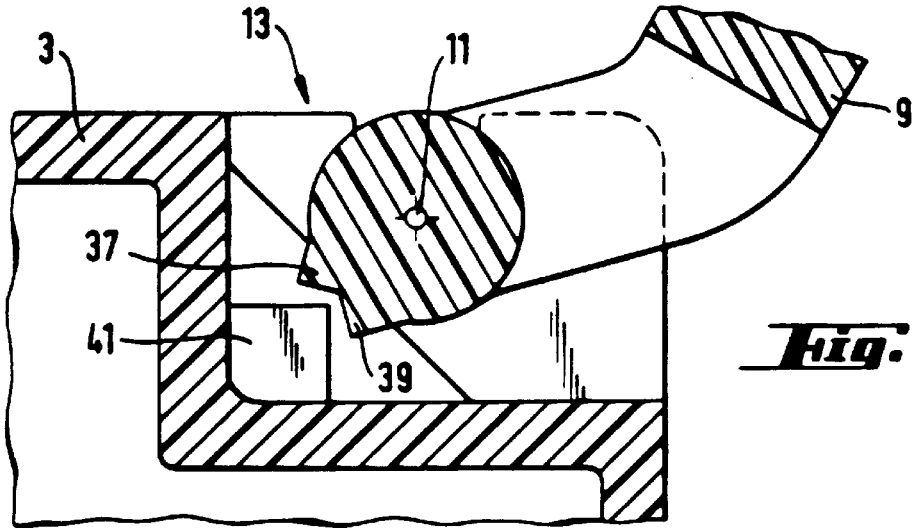

FIG. 6 shows an embodiment in which the cover 9 is provided with two protrusions 37,39 which engage a protrusion 41 on the lid 3.

What is claimed is:

1. Container (1) for containing a stack of moist wipes (7), the container comprising:

a container body (5) and a lid (3) covering the container body, the lid (3) comprising a dispensing aperture (15) and a hinging cover (9) connected to the lid (3) and overlying the dispensing aperture (15), wherein the hinging cover is pivotable around a hinging axis (11), wherein the container further comprises retention means (13) for keeping the cover (9) in a first opened position in which the cover (9) is pivoted around the hinging axis (11) by less than 180°, upon exertion of a predetermined force on the cover, the cover (9) being further hingeable around the hinging axis (11) from its first open position to a second open position by exertion of a second predetermined force on the cover (9).

2. Container (1) according to claim 1, wherein the retention means (13) keep the cover (9) in the first opened position wherein the cover (9) is pivoted at least 75° around the hinging axis (11).

3. Container (1) according to claim 1, wherein the retention means (13) comprise a first protrusion (17) on the cover (9), the first protrusion (17) being located near the hinging axis (11) and a second protrusion (19) provided on the lid (3), the first protrusion (17) upon opening of the cover (9) being rotatingly engageable with the second protrusion (19) to prevent further opening of the cover (9).

4. Container (1) according to claim 1 wherein the force to hinge the cover from its closed position to its first open position is between 1 and 50 N.

5. Container according claim 1 wherein the force to hinge the cover from its first open position to its second open position is at least 1 N.

6. Container (1) according to claim 1 wherein the cover (9) is pivoted around the hinging axis (11) by less than 135°.

7. Container (1) according to claim 1, wherein the lid (3) comprises a first protrusion (41) and the cover (9) comprises a stopping surface (35), the stopping surface (35) being upon opening of the cover (9) engageable with the first protrusion (41) on the lid (3) to prevent further opening of the cover (9).

8. A container for containing a stack of moist wipes, the container comprising:

a container body and a lid covering the container body, the lid comprising a dispensing aperture and a hinging cover connected to the lid and overlying the dispensing aperture, wherein the hinging cover is pivotable around a hinging axis, wherein the cover comprise a first protrusion being located near the hinging axis, and a recess provided on the lid, the first protrusion being rotatingly engageable with the recess for keeping the cover in a first opened position.

9. A container (1) for containing a stack of moist wipes (7), the container comprising:

a container body and a lid covering the container body, the lid comprising a dispensing aperture and a hinging cover connected to the lid and overlying the dispensing aperture, wherein the hinging cover is pivotable around a hinging axis, wherein the lid comprises a first protrusion and the cover comprises a second protrusion and a third protrusion located near the hinging access, the second and third protrusions being rotatingly engageable with the first protrusion on the lid for keeping the cover in a first opened position.

* * * * *